United States Patent [19]

Droller et al.

[11] Patent Number: 4,689,033

[45] Date of Patent: Aug. 25, 1987

[54] FIGURE TOY WITH RAPIDLY EXTENSIBLE TONGUE

[75] Inventors: Richard Droller, Prospect, Conn.; Brian Fontaine, Southbridge, Mass.

[73] Assignee: Coleco Industries, Inc., West Hartford, Conn.

[21] Appl. No.: 826,855

[22] Filed: Feb. 6, 1986

[51] Int. Cl.[4] ..... A63H 3/06; A63H 3/20; F41B 11/00

[52] U.S. Cl. ..... 446/183; 446/330; 446/340; 124/64

[58] Field of Search ..... 124/63, 64, 65, 79; 272/27 R, 27 N, 27 B, 8 N; 446/183, 184, 185, 180, 176, 197, 198, 308, 309, 310, 311, 320, 321, 327, 328, 330, 337, 339, 340, 473, 390, 361, 368

[56] References Cited

U.S. PATENT DOCUMENTS

| | | | |
|---|---|---|---|
| D. 171,234 | 12/1953 | Sugita | 446/198 X |
| 737,337 | 8/1903 | Cairns | 446/198 |
| 1,045,601 | 11/1912 | Parsells | 446/180 X |
| 1,324,646 | 12/1919 | Clements | 446/183 |
| 1,518,212 | 12/1924 | Mayne | 446/361 |
| 1,567,973 | 12/1925 | Mendelson | 446/198 |
| 2,310,781 | 2/1943 | Harris | 446/198 |
| 2,815,605 | 12/1957 | Connell | 446/368 |
| 3,160,981 | 12/1964 | Higgins, Jr. | 446/198 |
| 3,353,823 | 4/1965 | Sobel | 272/8 N |
| 3,577,676 | 5/1971 | Powell | 446/183 |
| 3,688,435 | 9/1972 | Sapkus et al. | 446/310 |
| 3,695,148 | 10/1972 | Baginski et al. | 446/308 X |
| 4,086,902 | 5/1978 | Reynolds | 124/64 X |
| 4,216,610 | 8/1980 | Ferris | 446/198 |
| 4,469,327 | 9/1984 | Ulrich et al. | 446/330 X |
| 4,575,349 | 3/1986 | Piazza et al. | 446/330 |
| 4,630,756 | 12/1986 | Amici et al. | 446/197 X |

FOREIGN PATENT DOCUMENTS

| | | | |
|---|---|---|---|
| 448936 | 9/1927 | Fed. Rep. of Germany | 446/330 |
| 2076667 | 12/1981 | United Kingdom | 446/340 |

*Primary Examiner*—Robert A. Hafer
*Assistant Examiner*—D. Neal Muir

[57] ABSTRACT

A toy creature figure has a tongue-like element that darts from the mouth of the figure when a pneumatic bulb, which comprises an integral part thereof, is squeezed. The component parts are few in number, assembly thereof is readily achieved, and manufacture of the figure is relatively simple and inexpensive.

6 Claims, 5 Drawing Figures

FIGURE TOY WITH RAPIDLY EXTENSIBLE TONGUE

BACKGROUND OF THE INVENTION

Various forms of toys having simulated, extensible tongue elements are old in the art, and in some instances they employ a compressible bulb for pneumatic actuation. Typical of the prior art constructions are those which are described in the following U.S. patents:

Sugita No. Des. 171,234 provides a bulb-actuated pop-up snake.

Cairns No. 737,337, shows a mechanical toy in which wings are operated by pressure upon an air bulb, which causes the rod of a piston connected thereto to move axially within a cylinder.

Clements No. 1,324,646 provides a snake-like toy in which a tongue, attached to a diaphragm, is extended by squeezing the body.

In Mayne No. 1,518,212, the mouth of a snake-like toy is caused to open by pulling a string, which is attached to elements of a bifurcated portion.

Squeezing a bulb causes the tongue of the toy disclosed in Harris No. 2,310,781 to extend from its mouth.

In Sobel No. 3,353,823 and Powell No. 3,577,676, a cord is ejected pneumatically, by squeezing a frog-like body normally containing it, to simulate tongue movement.

Despite the foregoing, it is believed that a demand exists for unique toys of this type.

Accordingly, it is an objective of the present invention to provide a novel toy creature figure, having a rapidly extensible simulated tongue, which is reliable and effective in operation, and is of relatively uncomplicated, durable and inexpensive construction.

It is a more specific object of the invention to provide such a toy figure in which the tongue member is operated by a manually compressible resilient pneumatic bulb, which may itself be designed to simulate a part of the creature.

Another object is to provide such a figure having leg-simulating elements provided by a one-piece member, which is easily and securely assembled with the body parts.

SUMMARY OF THE INVENTION

It has now been found that certain of the foregoing and related objects of the invention are attained by the provision of a toy creature figure comprised of a tubular member having substantially open opposite ends, a manually compressible resilient pneumatic bulb in air-flow communication with one end of the tubular member, a generally hollow, creature-simulating body, and an elongated piston member having a piston head element adjacent one end and a tongue-simulating portion at the other end thereof. The body of the toy has a mouth opening and a tail opening spaced from it, and the tubular member and the bulb are so mounted that the bulb protrudes from the tail opening of the body and the opposite end of the tubular member is aligned with the mouth opening thereof.

The piston member is slidably retained within the tubular member, and moves between a retracted position, with the piston head element adjacent the "one" end thereof and with the tongue-simulating portion lying generally inwardly of the mouth opening, and an extended position with the head element adjacent the "other" end of the tubular member and the tongue-simulating portion extended through the mouth opening and lying substantially outwardly of the body. By making the piston head element and the passage through the tubular member of substantially the same cross section, air forced into the tubular member (by compression of the bulb) and acting upon the head element will be effective to shift the piston member from the retracted position to the extended position, and thereby to thrust the tongue-simulating portion outwardly of the body.

Normally, the piston member will be substantially rigid, and the tubular member and the piston member will both be of substantially rectilinear configuration and aligned on a longitudinal axis of the body. In preferred embodiments, the tubular member will have a surrounding collar element at a location intermediate its ends. The bulb will have an opening through which an inner end portion of the tubular member extends, and will have a collar formation thereabout which abuts that of the tubular member. A plurality of internal engagement elements provided within the body extend generally transversely with respect to the tubular member; certain of them engage the outer end of the bulb collar formation, while others engage the end surface of the tubular member at the opposite end thereof, thus affixing the tubular member and bulb in position within the body.

Most advantageously, the piston member will comprise a tip element at the outermost end thereof, and an elongated shaft portion extending between the tip element and the piston head element. The shaft portion, but not the tip and head elements, will be of sufficiently small cross section to freely pass between the "other" engagement elements of the body, which will thereby serve to retain the piston member against disassembly from the tubular member. The figure may additionally include a one-piece leg member mounted upon the body and having a multiplicity of leg-simulating elements disposed substantially symmetrically thereon. The leg elements on opposite sides of the body may be connected by a bridging element, which is clamped between upper and lower body sections to secure the leg member in assembly therewith. In specific preferred embodiments, the body, bulb and leg member of the figure will simulate, respectively, the thoracic, abdominal and limb parts of an insect-like creature.

DETAILED DESCRIPTION OF THE ILLUSTRATED EMBODIMENT

Figure 1:
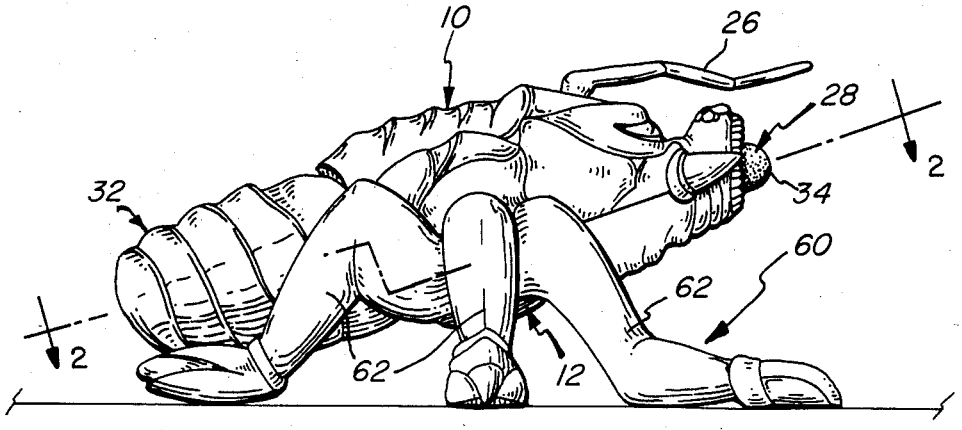
FIG. 1 is a side elevational view of a toy creature figure embodying the present invention.
Figure 2:
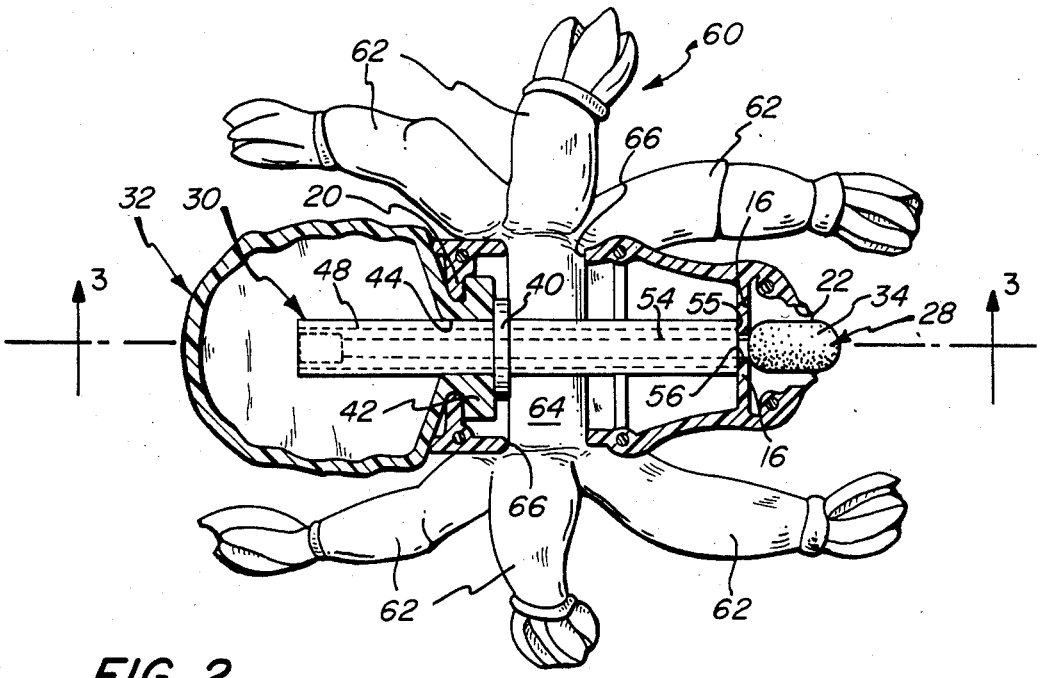
FIG. 2 is a sectional view of the toy of FIG. 1, taken along line 2—2 thereof.

The toy figure illustrated in the drawings is in the form of a fantastic, insect-like creature; it will of course be appreciated, however, that figures embodying the invention may take widely diverse forms. The toy shown consists of an upper or dorsal body section, generally designated by the numeral 10, and a lower or ventral body section, generally designated by the numeral 12, which together simulate a thoracic part. The sections 10, 12 are joined to one another by appropriate means (such as sonic welding or adhesive bonding), and small locating pins, with corresponding holes, may be provided in a conventional manner to facilitate assembly. The two sections have inwardly extending rib elements 14, 16, 18, 20 thereon, which serve a purpose to be hereinafter described, and a mouth opening 22 and a tail opening 24 are defined by the sections at the forward and rearward ends of the body; an antenna-like element is affixed within the dorsal section 10 near its forward end.

The tongue-simulating part, and its mounting and actuating components, consist of an elongated, substantially rectilinear tongue member, generally designated by the numeral 28, an open-ended, generally rectilinear tubular member or sleeve, generally designated by the numeral 30, and a resilient, manually compressible pneumatic bulb, which simulates an abdominal part of the creature and is generally designated by the numeral 32. The tongue member 28 has a tip element 34 and a piston head element 36 at its forward and rearward ends, respectively, joined by an elongated shaft portion 38 which is of reduced cross section relative thereto.

The sleeve 30 has a surrounding annular collar element 40 located approximately midway along its length, and the bulb 32 also has a collar formation 42 surrounding the orifice 44 leading to its internal chamber 46. The respective collars abut one another when the sleeve and bulb 30, 32 are assembled, as shown in FIG. 3, thus limiting the depth of penetration of the inner end portion 48.

The tongue member 28 is inserted into the sleeve 30 with the head element 36 thereof adjacent the opening 50 in the inner end portion 48, and with the tip element 34 projecting from the opening 52 in the outer end portion 54. The sub-assembly is mounted within the body sections 10, 12 with the end surface 55 of the forward portion 54 of the sleeve 30 abutting against the ribs 14, 16, and with the ribs 18, 20 gripping the bulb 30 behind its collar formation 42, thereby maintaining the sleeve and bulb in assembly and securing them in position within the body of the toy figure.

As will be noted, the inner end portions of the ribs 14, 16 are spaced from one another so as to define a relatively small passage 56 therebetween. It is large enough to permit free movement therethrough of the shaft portion 38 of the tongue member 28, but not the tip element 34 or the piston head element 36. Consequently, the tongue member 28 is trapped within the sleeve 30, while being freely slidable between its retracted and extended positions, shown in full line and phantom line, respectively, in FIG. 3.

Figure 3:
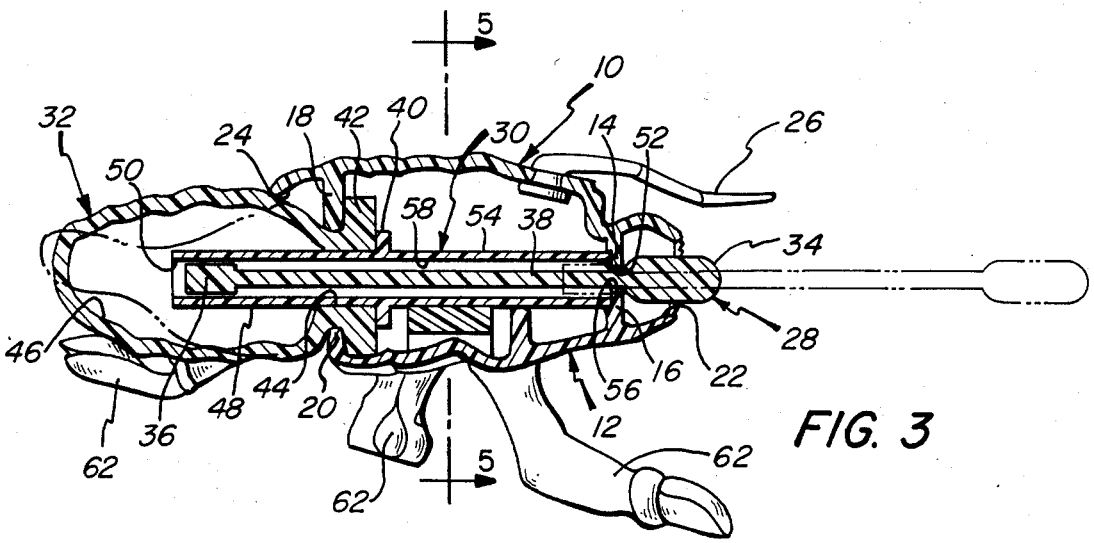
FIG. 3 is a sectional view of the toy taken along line 3—3 of FIG. 2.
Figure 4:
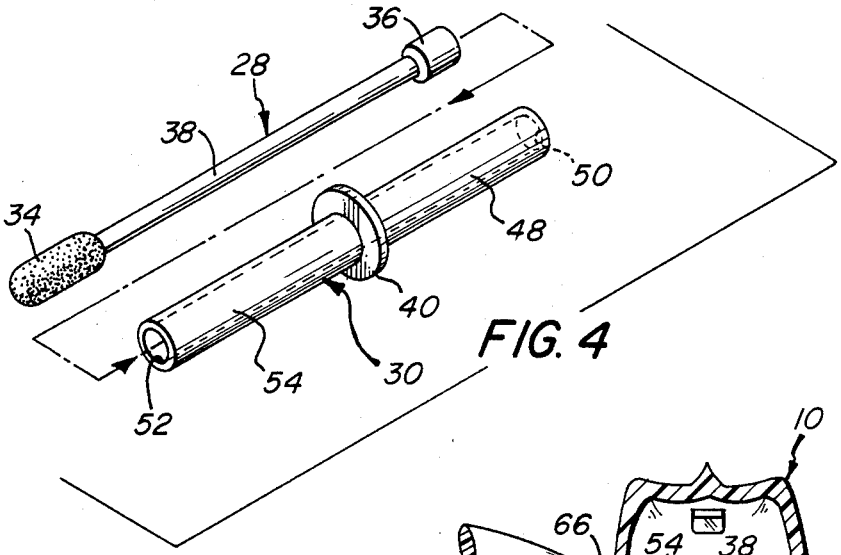
FIG. 4 is an exploded perspective view of the tongue-simulating member, and the sleeve in which it is mounted, used in the toy figure of the invention.
Figure 5:
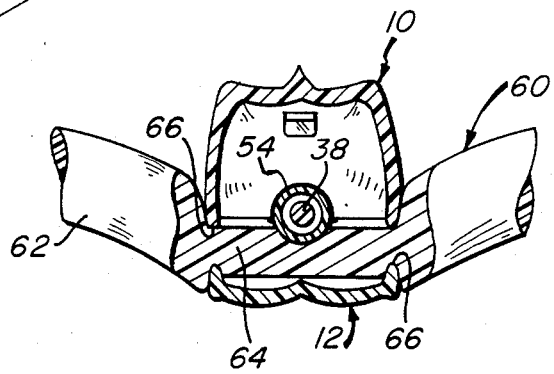
FIG. 5 is a fragmentary view of the toy taken along line 5—5 of FIG. 3.

It will readily be appreciated that extension of the tongue member is achieved simply by squeezing the bulb 32, as is also indicated in phantom line in FIG. 3. The resultant air pressure will of course act upon the piston head element 36 (which is of approximately the same cross section as the passageway 58), to force the tongue member 28 outwardly and thereby to cause the tip element 34 to dart from within the mouth opening 22. Release of the bulb 32 will create a vacuum effect, thereby retracting the tongue member 28 to its withdrawn position.

The toy figure of the invention also includes a leg member, generally designated by the numeral 60, which is integrally formed to simulate six legs 62 symmetrically disposed on opposite sides of the body. The legs 62 are interconnected by a bridge element 64 which extends transversely through the body and is engaged between the assembled body sections 10, 12, the latter defining lateral openings 66 for the element 64.

Generally, the parts of the toy figure will be fabricated from suitable plastic materials; thus, the body parts and the sleeve may advantageously be made of acrylonitrile/butadiene/styrene resin, the leg member and the pneumatic bulb may be made of relatively low durometer poly(vinylchloride) resins, and the tongue member may be of high density polyethylene. The latter will generally be relatively rigid and rectilinear, although somewhat flexible and/or curvilinear structures may be employed if so desired.

Thus, it can be seen that the present invention provides a novel toy creature figure, having a rapidly extensible simulated tongue, which is reliable and effective in operation and is of relatively uncomplicated, durable and inexpensive construction. The tongue member is operated by a manually compressible resilient pneumatic bulb, which may itself be designed to simulate a part of the creature, and the toy may have leg-simulating elements, provided by a one-piece leg member which is easily and securely assembled with the body parts.

Having thus described the invention, what is claimed is:

1. A toy creature having a rapidly extensible simulated tongue comprising:

a tubular member having substantially open opposite ends;

a manually compressible resilient pneumatic bulb in air-flow communication with one end of said tubular member;

a generally hollow, creature-simulating body having a mouth opening and a rearward opening spaced therefrom, said tubular member and said bulb being mounted within said body with said bulb protruding from said rearward opening and with the other end of said tubular member aligned with said mouth opening; and an elongated piston member having a piston head element adjacent one end and a tongue-simulating portion at the other end thereof, said piston member being slidably retained within said tubular member for movement between a retracted position, with said piston head element adjacent said one end of said tubular member and with said tongue-simulating portion lying generally inwardly of said mouth opening, and an extended position with said heat element adjacent said other end of said tubular member and said tongue-simulating portion extended through said mouth opening and lying substantially outwardly of said body, said piston head element and the passage through said tubular member being of substantially the same cross section, so that air forced into said tubular member by compression of said bulb and acting upon said head element will be effective to shift said piston member from said retracted position to said extended position, and thereby to thrust said tongue-simulating portion outwardly.

2. The figure of claim 1 wherein said piston member is substantially rigid, and wherein said tubular member and said piston member are both of substantially linear configuration.

3. The figure of claim 1 wherein said tubular member has a collar element extending thereabout at a location intermediate said ends thereof, wherein said bulb has an opening thereinto through which an inner end portion of said tubular member extends to mount said bulb thereon, and has a collar formation thereon surrounding said opening and abutting said collar element of said tubular member, and wherein said body has a plurality of internal engagement elements extending generally transversely with respect to said tubular member, certain of said engagement elements engaging the outer end of said bulb collar formation and other of said elements engaging the end surface of said tubular member at said other end thereof, said engagement elements thereby affixing said tubular member and bulb in position within said body.

4. The figure of claim 3 wherein said piston member comprises a tip element at the outermost end thereof and an elongated shaft element extending between said tip element and said piston head element, said shaft element, but not said tip and head elements, being sufficiently small cross section to freely pass between said other engagement elements of said body, said other engagement elements thereby serving to retain said piston member against disassembly from said tubular member.

5. The figure of claim 1 additionally including a one-piece leg member mounted upon said body and having a multiplicity of leg-simulating elements disposed substantially symmetrically thereon, and wherein said body consists of an dorsal section and a ventral section joined to one another, said leg elements on opposite sides of said body being connected by a bridging element which is clamped between said body sections to secure said leg member in assembly therewith.

6. The figure of claim 5 wherein said body, bulb and leg member simulate, respectively, the thoracic abdominal and leg parts of an insect-like fantasy creature.

* * * * *

UNITED STATES PATENT AND TRADEMARK OFFICE

CERTIFICATE OF CORRECTION

PATENT NO. : 4,689,033

DATED : August 25, 1987

INVENTOR(S) : Richard Droller and Brian Fontaine

It is certified that error appears in the above-identified patent and that said Letters Patent is hereby corrected as shown below:

Column 4, line 30, after "creature" insert --figure--.

Column 4, line 53, "heat" should be --head--.

Signed and Sealed this

Eighth Day of March, 1988

*Attest:*

DONALD J. QUIGG

*Attesting Officer*

*Commissioner of Patents and Trademarks*